United States Patent [19]

Krueger

[11] Patent Number: 4,889,473

[45] Date of Patent: Dec. 26, 1989

[54] PRODUCTION PLUNGER

[75] Inventor: W. E. "Wes" Krueger, Anderson, Tex.

[73] Assignee: E-Z Lift Pump, Inc., College Station, Tex.

[21] Appl. No.: 299,130

[22] Filed: Jan. 23, 1989

[51] Int. Cl.[4] ..... F04B 47/12

[52] U.S. Cl. ..... 417/56; 417/555.2

[58] Field of Search ..... 417/56, 446, 447, 448, 417/555 A, 559, 57, 58, 59

[56] References Cited

U.S. PATENT DOCUMENTS

| | | | |
|---|---|---|---|
| 862,867 | 8/1907 | Eggleston | 417/390 |
| 1,836,871 | 12/1931 | Ricker | 417/56 |
| 1,846,000 | 3/1932 | Fletcher | 417/53 |
| 1,919,547 | 7/1933 | Fletcher | 417/60 |
| 1,943,553 | 1/1934 | Ricker | 417/56 |
| 4,070,134 | 1/1978 | Gramling | 417/56 |
| 4,113,010 | 12/1978 | Gramling | 166/213 |
| 4,712,981 | 12/1987 | Gramling | 417/56 |

*Primary Examiner*—Carlton R. Croyle
*Assistant Examiner*—Robert N. Blackmon
*Attorney, Agent, or Firm*—Vaden, Eickenroht, Thompson & Boulware

[57] ABSTRACT

A production plunger is disclosed that will automatically reciprocate in the production string of a producing oil well that is also producing some gas. The plunger includes a body having a passageway that allows fluid to bypass the packer cups carried by the body. A valve in the passageway is held open by a bellows filled with air under pressure. The valve is closed by the pressure of the liquid accumulated above the plunger at which time, the gas produced by the well will lift the plunger and the liquid above it to the surface.

6 Claims, 1 Drawing Sheet

PRODUCTION PLUNGER

Figure 1:
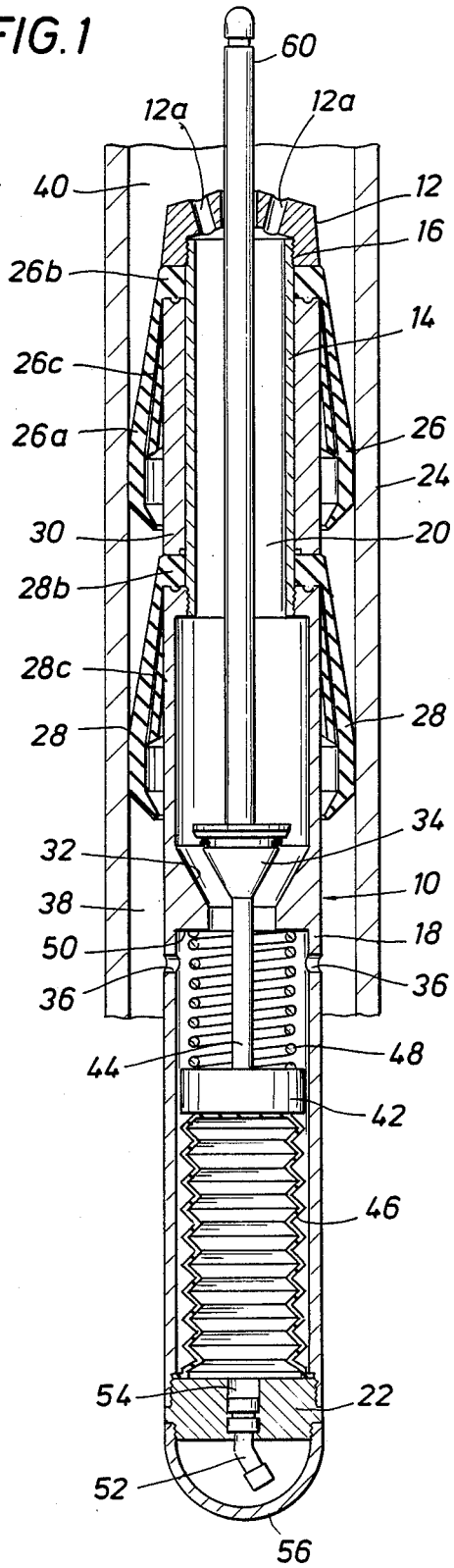

This invention relates to production plungers generally, and in particular, to plungers that operate automatically in response to downhole conditions in the well being produced.

Generally, production plungers of the type to which this invention is related are used in oil wells that also produce some gas. They can also be used in a gas well that produces some liquid that needs to be removed from time to time.

The plungers include a body that reciprocates in the production string of the well being produced. The body carries seals that engage the inside walls of the production string and a valve located in a passageway through which fluid can bypass the seals carried by the body. This allows the plunger to fall downwardly through the fluid in the production string when the valve in the passageway is open and to utilize the pressure of the produced gas below the seals of the plunger to lift the plunger and the liquid that has accumulated above it to the surface when the valve in the passageway is closed.

For the plunger to work automatically some means must be provided to hold the valve open as the plunger falls downwardly to a selected position in the lower end of the production string and to close the valve when a preselected volume of liquid has accumulated in the production string above the plunger. The valve must remain closed as the plunger and the liquid above it are moved upwardly through the production string to the surface, where the valve is again opened for the trip back down the production string.

The plunger of this invention uses air under pressure to control the opening and closing of the valve. There are two prior art patents that also use air for this purpose. These are U.S. Pat. Nos. 1,836,871 to Ricker and 4,070,134 to Gramling. There are substantial structural and functional differences in the manner in which Ricker and Gramling use air pressure as compared to the manner in which it is used in this invention. For example, both Ricker and Gramling use a piston moving in a cylinder to open and close the valve. Should the seal between the piston and cylinder fail, the valve will not close. Further, with Ricker's arrangement, when the valve is closed, the only force holding the valve closed comes from the pressure of the gas below the plunger acting across the area of the valve seat. In Gramling's plunger, the gas below the plunger urges the valve closed by acting only across the valve seat once the valve closes. The pressure of the liquid above the valve is the only other force available to exert sufficient pressure on the piston to keep the valve closed and this pressure will not increase. Meanwhile, the liquid above the valve is urging it open.

It is an object of this invention to provide a plunger of the type described in which the only force urging the valve open, other than the confined air under pressure, is the force exerted on the valve by the pressure of the well fluid below the valve.

It is another object of this invention to provide a plunger of the type described above that employs air under pressure to urge the valve to the open position and is arranged structurally so that the liquid above the plunger that is being lifted to the surface by the plunger also acts to urge the valve to the closed position.

It is another object of this invention to provide such a plunger that includes resilient means that will close the valve should air pressure be lost.

It is a further object and one of the features of this invention to employ an air-filled bellows to provide the force urging the valve to the open position to thereby eliminate the need for a sliding seal between a piston and cylinder as used in the prior art and to allow the pressure in the bellows to be adjusted at the surface to change the volume of fluid that must accumulate above the plunger in order to close the valve.

It is an additional object and feature of this invention to provide a resilient member, such as a spring, that urges the valve toward the closed position so that the loss of air pressure in the bellows will cause the valve to close thereby allowing the gas in the well to move the plunger to the surface where it can be recovered and repaired without having to fish the plunger out of the production string using a wireline.

These and other objects, advantages, and features of this invention will be apparent to those skilled in the art from a consideration of the following description of the invention along with the drawings and the claims.

IN THE DRAWINGS

Figure 2:
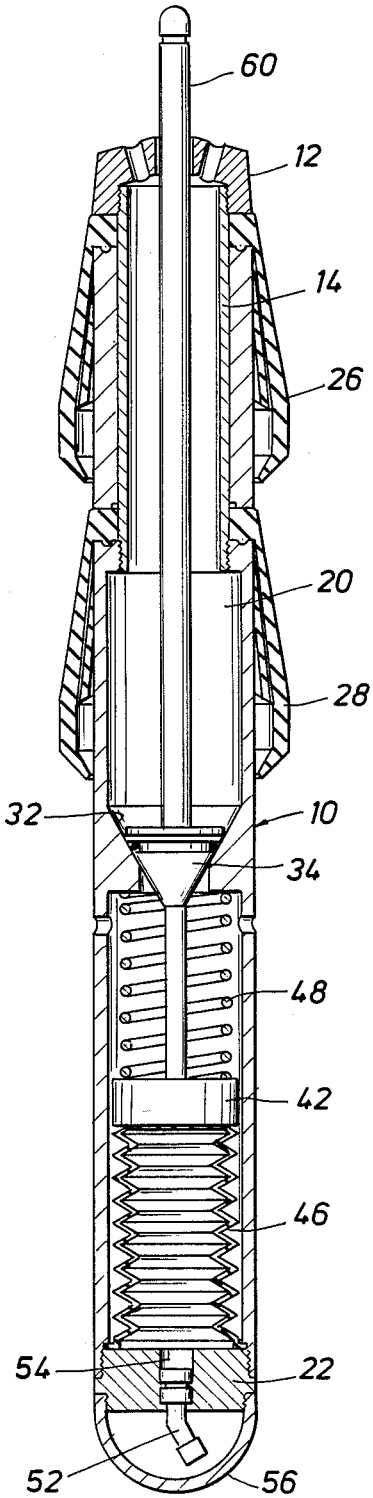

FIG. 1 is a vertical sectional view of the plunger of this invention with the valve in the open position; and FIG. 2 is a similar view showing the valve of the plunger in the closed position.

The plunger includes a generally tubular body 10 that is made up of several sections connected together. Beginning at the top, upper cap 12 is attached to sleeve 14 by threads 16. The lower end of sleeve 14 is connected by threads to lower tubular body section 18. Each section of the body combines to provide a common passageway 20 that extends the length of the body except where it is closed at the lower end of lower body section 18 by end plate 22.

Seal means are carried by the body for engaging the inner wall of the production string to prevent fluid flowing upwardly in the production string from passing between the body and the inner wall of the production string. A portion of production string 24 is shown in FIG. 1. This can be either the tubing or casing string of a well, but in any event, it is the conduit through which fluid is carried to the surface and is referred to herein as the production string. In the embodiment shown, the seal means includes two packer cups 26 and 28. The packer cups have cup-shaped portions **26*a* and 28*a* and base portions 26*b* and 28*b*. The cups are made of elastomeric material. The cup portions are provided with reinforcing wires 26*c* and 28*c*. The lower cup is clamped on the outside surface of sleeve 14 between the upwardly facing end of lower body section 18 and spacer 30. The upper cup is clamped between the upwardly facing surface of spacer 30 and upper cap 12**. These packer cups are designed to seal in one direction only since, in normal service, there will be a pressure differential across these cups only in an upward direction.

Valve seat 32 is located in lower body section 18 and valve element 34 is positioned above the valve seat. Ports 36 are located below the valve seat and extend laterally through the wall of lower body section 18. The ports connect passageway 20 with annulus 38 between the plunger body and the production string below the packer cups. The passageway combines with ports 36 to allow fluid to flow from annulus 38 below the cups to annulus 40 above the packer cups when valve element 34 is spaced from valve seat 32 as shown in FIG. 1. This would be the configuration of the valve when the plunger is traveling downwardly through the production string.

Means containing air under pressure is provided for urging the valve member away from seat 32, i.e., urging the valve to its open position. In the embodiment shown, piston 42 is located in the lower portion of lower body section 18 below the valve seat. The piston is connected to valve element 34 by piston rod 44. Bellows 46 is located between the piston and plate 22 The bellows contains air under pressure. The bellows preferably is made of elastomeric material and has accordian-like side walls to allow the bellows to expand and collapse under the changing pressure conditions in which the plunger operates.

The air pressure in bellows 46 urges valve member 34 away from the valve seat through piston 42 and piston rod 44. Means are also provided to urge the valve member toward the valve seat. In the embodiment shown, coil spring 48 is located between shoulder 50 on the lower body section below the valve seat and piston 42. The spring urges the piston downwardly which would cause the valve member to move toward the valve seat. Consequently, there should be sufficient air pressure in bellows 46 to ensure that it exerts a larger force upwardly urging the valve member away from the valve seat than the downward force of spring 48.

Depending on the amount of oil or water or both being produced by the well in which the plunger is operating and the available gas pressure to lift the plunger to the surface, the height of the column of liquid to be allowed to accumulate above the plunger before the valve closes can be determined. Knowing the pressure that this column of liquid will exert on the bellows, the pressure in the bellows is adjusted so that the valve will be closed when the bellows is subjected to that pressure. The pressure in the bellows is adjusted through valve stem 52 located in opening 54 in end plate 22. Lower cap 56 is attached to the end plate and provides protection for the valve stem.

In operation then, the plunger travels downwardly through the production string until it reaches a stop placed in the production string. With the valve open, as shown in FIG. 1, fluids produced by the well flows through ports 36, passageway 20, and ports 12*a* in upper cap 12, and rises in the production string above the plunger. Nothing will happen until the liquid produced by the well, which may be oil, water, or mixture of both, accumulates above the plunger far enough to provide enough pressure acting on piston 42 to overcome the pressure exerted upwardly by bellows 46 and move the valve to its closed position, as shown in FIG. 2. At that point, the pressure of the gas that is produced along with the liquids will build up until it is sufficient to move the plunger, along with the liquid accumulated above the plunger, to the surface where it flows from the wellhead to storage tanks or production facilities of some kind.

As explained above, it is one of the features of this invention that should bellows 46 rupture for any reason and lose its air pressure, which would cause the pressure across piston 42 to equalize, spring 48 will close the valve. Then the gas produced by the well will build up sufficiently to move the plunger to the surface where it can be retrieved and repaired without having to fish the plunger out of the well in the conventional manner.

Should, however, for some reason, spring 48 does not close the valve or the valve leaks or there is insufficient gas build-up to lift the plunger, then the plunger can be retrieved in a conventional manner using a wireline and an overshot. The overshot (not shown) will attach itself to the fishing neck provided at the top of rod 60 that is connected to valve member 34 and extends upwardly above the plunger. The upward pull of the wireline will hold the valve open allowing the fluid in the production string to bypass the packer cups as the plunger is raised to the surface.

As explained above, one of the features of this invention is that the pressure exerted by the liquids above the plunger are exerting a force tending to hold the valve closed. The gas pressure below the valve is, of course, tending to urge the valve to open acting across the area of the valve seat engaged by the valve member. This is the only force urging the valve open, except for that provided by the bellows. Usually the pressure differential across the valve is not great. Whatever the differential is, however, the same pressure acting against the valve member is also acting on piston 42 urging it downwardly. Since the area of the piston is much greater than that of the valve member exposed to this pressure, the valve will remain closed whatever the differential across the valve.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because man possible embodiments may be made of the invention without departing from the scope thereof, it is to be understood that all matter herein set forth or shown in the accompanying drawings is to be interpreted as illustrative and not in a limiting sense.

What is claimed is:

1. A production plunger for reciprocating in the production string of wells that produce both liquid and gas to assist the gas in lifting produced liquid to the surface comprising a body for reciprocating in the production string of a well, said body having a passageway extending longitudinally through the body, and means closing the lower end of the passageway, seal means carried by the body for engaging the inner wall of the production string to prevent fluid flowing upwardly in the production string from passing between the body and the inner wall of the production string, a valve seat in the passageway, a valve member located in the passageway in the body above the valve seat, a valve rod connected to the valve member and extending downwardly through the valve seat, a piston connected to the valve rod below the valve seat, means containing air under pressure below the piston exerting an upward force on the piston urging the valve member away from the valve seat, an opening in the body below the valve seat through which liquid produced by the well can flow into the passageway in the body and upwardly through the valve seat until the liquid accumulated above the piston is sufficient to compress the air below the piston and close the valve thereby allowing the gas pressure below the plunger to move the plunger and the liquid above the plunger to the surface.

2. The plunger of claim 1 further provided with resilient means urging the valve member toward the valve seat to close the valve should air pressure be lost below the piston to allow the gas in the well to move the plunger to the surface.

3. The plunger of claim 1 or 2 further provided with means to vary the pressure in the air containing means to vary the force exerted by the air containing means urging the valve member away from the valve seat.

4. The plunger of claims 1 or 2 in which the means containing air is a bellows having accordian-like walls.

5. A production plunger for reciprocating in the production string of wells that produce both liquid and gas to assist the gas in lifting produced liquid to the surface comprising a body for reciprocating in the production string of a well, said body having a passageway extending longitudinally through the body, and means closing the lower end of the passageway, seal means carried by the body for engaging the inner wall of the production string to prevent fluid flowing upwardly in the production string from passing between the body and the inner wall of the production string, a valve seat in the passageway, a valve member located in the passageway in the body above the valve seat, a valve rod connected to the valve member and extending downwardly through the valve seat, piston connected to the valve rod below the valve seat, bellows containing air under pressure below the piston exerting an upward force on the piston urging the valve member away from the valve seat, an opening in the body below the valve seat through which liquid produced by the well can flow into the passageway in the body and upwardly through the valve seat until the liquid accumulated above the piston is sufficient to compress the air below the piston and close the valve thereby allowing the gas pressure below the plunger to move the plunger and the liquid above the plunger to the surface, and resilient means urging the valve member toward the valve seat to close the valve should the pressure in the bellows be lost to allow the gas in the well to move the plunger to the surface.

6. The plunger of claim 5 further provided with means to vary the pressure of the air in the bellows to vary the force exerted by the bellows urging the valve member away from the valve seat.

* * * * *